United States Patent [19]

Armour

[11] 3,968,014

[45] July 6, 1976

[54] COLLECTION DEVICE FOR COKE OVEN GASES

[75] Inventor: Frank K. Armour, Flossmoor, Ill.

[73] Assignee: Interlake, Inc., Chicago, Ill.

[22] Filed: Mar. 29, 1974

[21] Appl. No.: 456,056

[52] U.S. Cl. ..... 202/263; 202/261; 214/18 PH

[51] Int. Cl.[2] ..... C10B 31/00; C10B 31/04; C10B 35/00

[58] Field of Search ..... 202/263, 251, 261, 270; 214/18 PH, 35 R; 110/101 CF; 13/33

[56] References Cited

UNITED STATES PATENTS

| | | | |
|---|---|---|---|
| 1,366,434 | 1/1921 | Thomson | 110/101 CF |
| 1,855,191 | 4/1932 | King | 202/263 X |
| 2,347,964 | 5/1944 | Otto | 202/263 |
| 3,709,387 | 1/1973 | Kinzler et al. | 214/18 PH X |
| 3,791,320 | 2/1974 | Gidick | 214/18 PH X |
| 3,862,889 | 1/1975 | Lowe | 202/263 |

*Primary Examiner*—Morris O. Wolk
*Assistant Examiner*—Bradley R. Garris
*Attorney, Agent, or Firm*—Prangley, Dithmar, Vogel, Sandler & Stotland

[57] ABSTRACT

A system for preventing effluents containing coal dust from being emitted from a coke oven upon charging the coke oven with coal. A U-tube mounted on a larry car interconnects the charging oven with a coking oven and an air valve mixes air with the effluents being transferred from the charging oven to the coking oven. A venturi tube is in communication with the coking oven on the side thereof away from the U-tube and has a steam jet therein to provide sufficient draft across the coking oven to draw the effluents. The restriction in the venturi tube accelerates the effluents through the venturi tube to accommodate all of the effluents produced during the charging of the coke oven.

10 Claims, 8 Drawing Figures

COLLECTION DEVICE FOR COKE OVEN GASES

BACKGROUND OF THE INVENTION

Coke making is an extremely dirty process and one of the most polluting operations during the coking of coal is the loading or charging of coal into the coke oven. Because most charging operations are done through loading ports in the top of the coke oven, the coal drops distances up to 20 feet or more, which creates large amounts of coal dust. The charging of an entire oven takes only a few minutes, whereby large quantities of coal are rapidly charged to the ovens which increases the pressure in the oven forcing the coal dust through cracks and crevices in the oven to the atmosphere. This invention is directed to a system for preventing effluents containing coal dust from being emitted from coke ovens during the charging of coal thereto.

SUMMARY OF THE INVENTION

This invention relates to a system for preventing effluents containing coal dust from being emitted from coke ovens upon charging of the ovens with coal. More particularly, this invention relates to a system interconnecting an oven being charged with coal with an oven coking coal and drawing the effluents from the charging oven through the coking oven to prevent pressure build-up in the charging oven that results in leaking coal dust to the atmosphere.

It is a principle object of the present invention to provide a system for preventing effluents containing coal dust from being emitted from coke ovens during the charging of coke ovens with coal.

An important object of the present invention is to provide a system for preventing effluents containing coal dust from being emitted from coke ovens upon charging certain of the coke ovens with coal while coking in others of the coke ovens, comprising means for providing communication between one end of an oven being charged with coal and one end of an oven coking coal, means for introducing air into the coking oven with the effluents flowing from the charging oven through the communication means, a venturi tube in communication with the other end of the coking oven, the venturi tube having a restriction therein to accelerate effluents therethrough at a rate sufficient to accommodate substantially all of the effluents produced during the charging of the coke oven, and means connected to the venturi tube for reducing the pressure in the venturi tube and in the coking oven adjacent thereto to increase the draft across the coking oven thereby facilitating flow of effluents from the charging oven through the coking oven to the venturi tube, whereby effluents containing coal dust produced during the charging of coal are drawn through the coking oven with sufficient oxygen to incinerate the coal dust and are accelerated through the venturi tube sufficiently to prevent effluents containing coal dust from leaking to the atmosphere due to pressure build-up in the charging oven.

Another object of the present invention is to provide a system of the type set forth in which a larry car having a plurality of coal hoppers thereon for transporting coal from a source thereof to a coke oven to be charged with coal carries the venturi tube thereon to position the venturi tube in communication with the coking oven.

A further object of the present invention is to provide a system of the type set forth wherein a U-tube interconnects the charging oven with the coking oven and is carried by the larry car along with the motor mechanism necessary to move the U-tube between the various positions thereof.

These and other objects of the present invention together with further objects and advantages thereof will best be understood by reference to the following specifications taken in connection with the accompanying drawings:

DESCRIPTION OF THE PREFERRED EMBODIMENT

Figure 1:
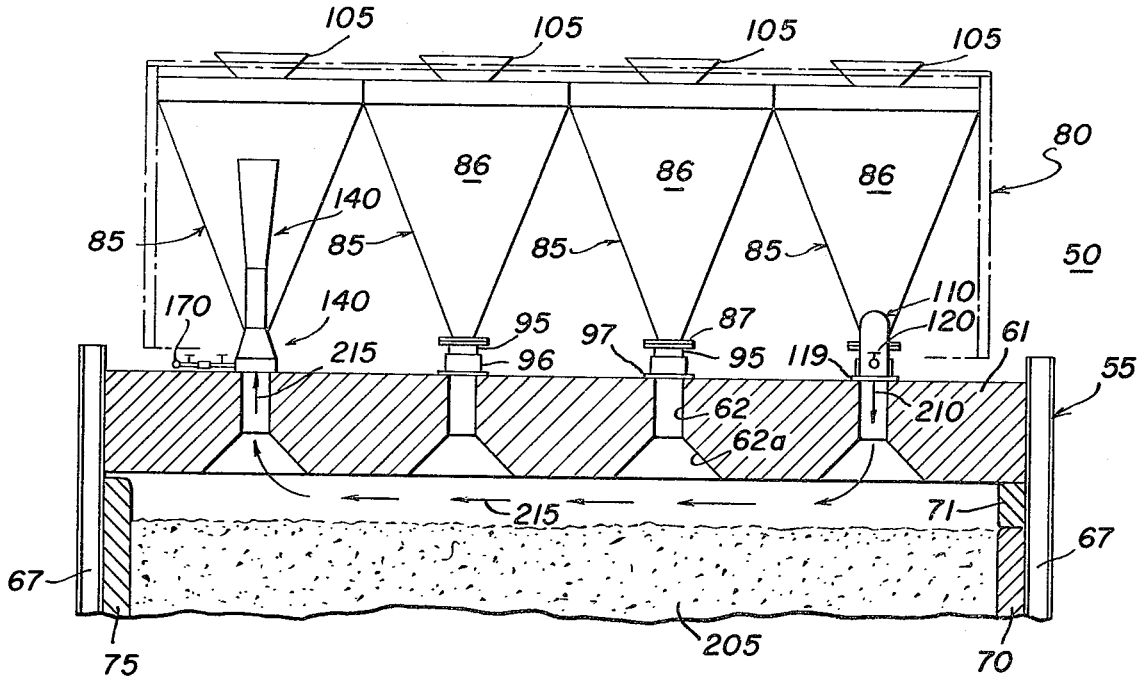
FIG. 1 is a side elevational view partly in section of the system of the present invention particularly showing a coking oven in communication with a U-tube at one end and a venturi tube at the other end.
Figure 2:
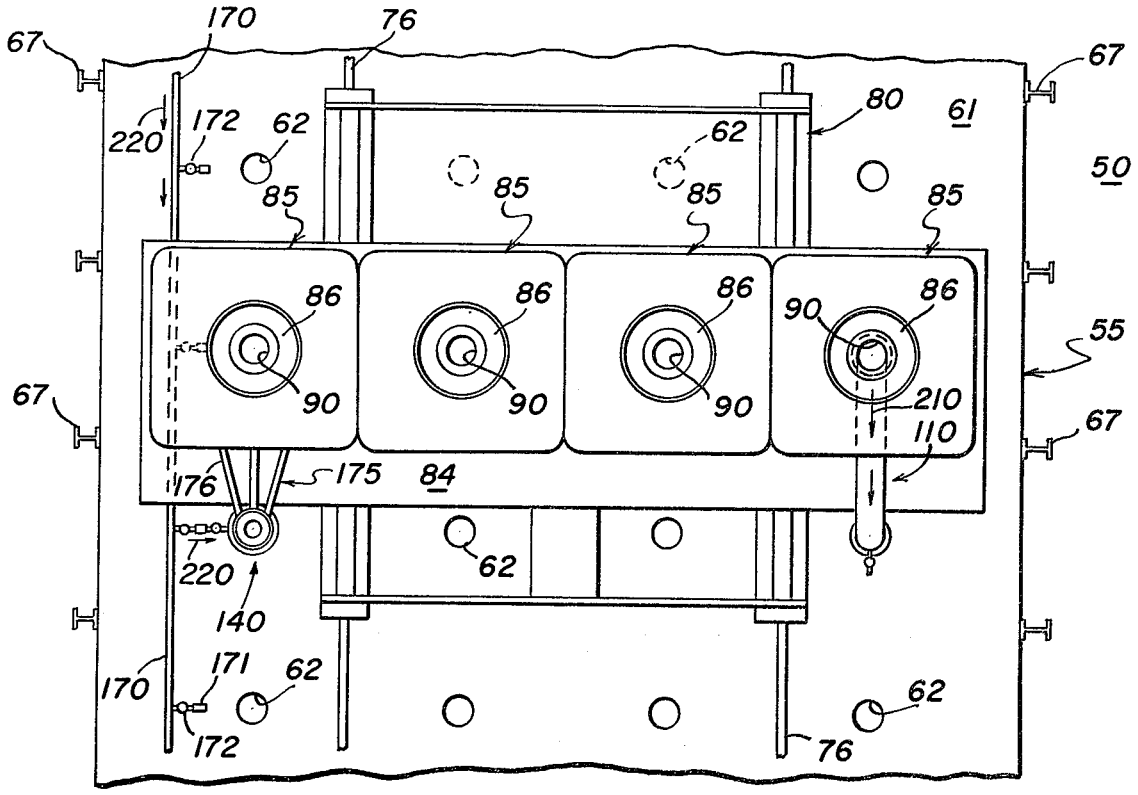
FIG. 2 is a top elevational view of the system illustrated in FIG. 1, particularly illustrating the spatial relationship between the larry car, the charging oven and the coking oven.

Referring to the drawings and particularly FIGS. 1 and 2 thereof, there is disclosed a system 50 for preventing effluents containing coal dust from being emitted from coke ovens upon charging the coke ovens with coal. A bank of coke ovens 55 includes a plurality of side-by-side ovens 60. Each of the ovens 60 is identical construction with the ovens being charged with coal being denoted 60a and the ovens coking coal being denoted 60b. An oven roof 61 is common to each of the ovens 60 and is provided with a plurality of loading ports 62 with each oven 60 having four such ports. Each of the oven ports 62 has a large conical portion at the end thereof to prevent clogging during loading and each of the ports 62 is provided with a top 63 (FIG. 3) which is removed during the operation of the system as hereinafter set forth. Each of the ovens 60 has spaced-apart side walls 64 which interconnect the pusher-side oven door 70 and the coke side oven door 75. Buckstays 67 are positioned on the outside of the ovens 60 and form support structure for the door mechanisms. The pusher-side oven door 70 is associated with a chuck door 71 for allowing a leveler bar to be inserted into the coke oven 60 to smooth and even out the charge of coal.

Spaced apart railway rails 76 permanently mounted to the top 61 of the bank of coke ovens 55 and run the entire length thereof. A larry car 80 is provided with railway wheels 81 journalled on shafts 82 and bearings 83 to facilitate movement of the larry car 80 along the rails 76 between a source of coal (not shown) and the individual coke oven 60*a* to be charged. The larry car 80 is provided with a platform 84 and support structure on which is mounted a plurality of coal hoppers 85. The number of coal hoppers 85 on the larry car 80 generally corresponds to the number of loading ports 62 in the individual coke ovens 60, and in this particular illustration, four such coal hoppers 85 are provided. Each of the coal hoppers 85 includes a conical wall 86 which terminates at the bottom thereof in an outwardly extending flange 87. An aperture 90 at the bottom of the coal hopper 85 provides an outlet for coal stored in the hopper. A sliding valve 88 is positioned intermediate the flange 87 and a corresponding flange 89 connected to the flange 87 by rivets and bolts (not shown). The flange 89 forms the top of a discharge tube 95 which extends downwardly from the associated coal hopper 85. The discharge tube 95 has a slidable sleeve 96 thereon with a sealing flange 97 at the distal end of the sleeve. A lever actuator 98 connected to the sliding valve 88 facilitates movement of the valve between an open position thereof wherein communication is established between the coal hopper 85 and the discharge tube 95 and a closed position thereof wherein communication is interrupted between the coal hopper and the discharge tube. Finally, each of the coal hoppers 85 is provided with a loading port 105 at the top thereof constructed and arranged to be sealed during the discharge of coal from the hoppers 85 into the charging oven 60*a*.

A U-tube 110 is constructed and arranged to establish communication between the oven 60*a* being charged with coal and the adjacent oven 60*b* coking coal. The U-tube 110 has a leg 111 is communication with the sleeve 96 of the discharge tube 95. A transition section 112 interconnects the leg 111 with a bight section 113. The bight section 113 is connected to two transition sections 116 and 117 which are connected to a leg 118. The leg 118 has a flange 119 at the bottom thereof. A mounting plate 115 is fixedly secured to the bight 113 by spaced apart rings 114. Finally, an air valve 120 is mounted on the leg 118 of the U-tube 110 and has a control 121 for regulating the amount of air admitted to the U-tube 110.

Figure 3:
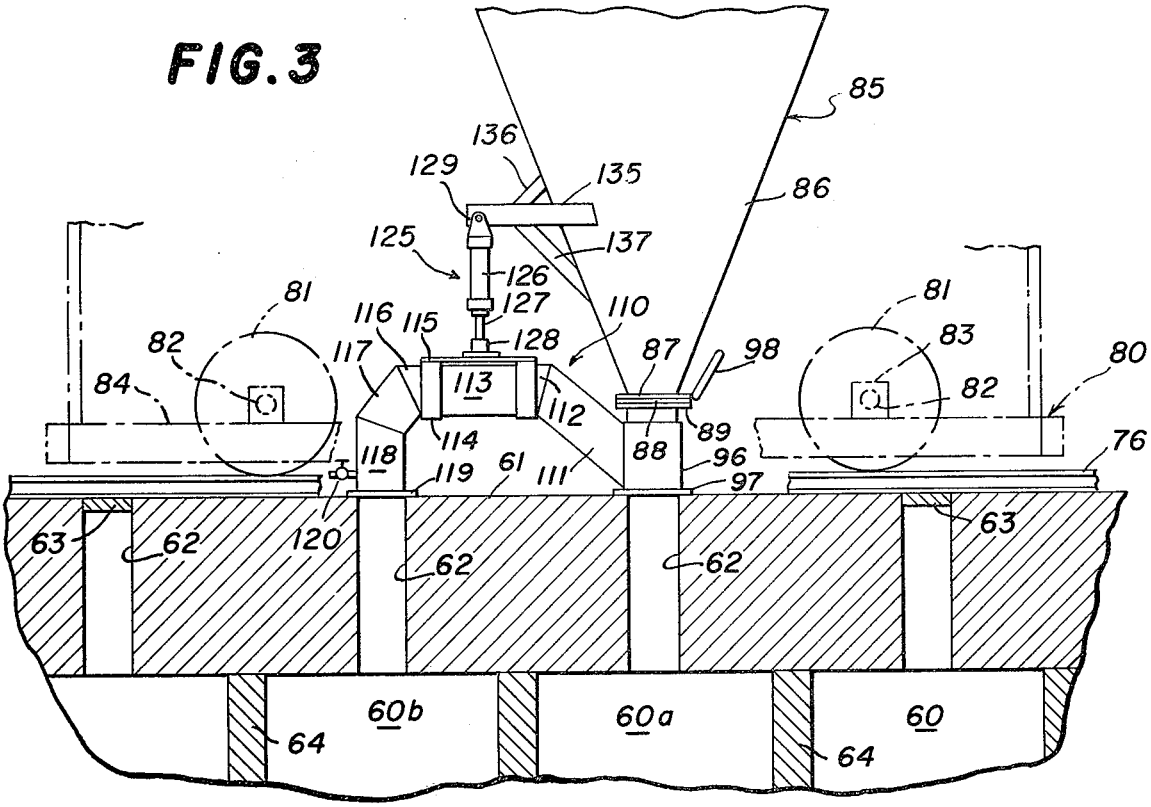
FIG. 3 is an enlarged side elevational view partly in section of the larry car, the U-tube and the coke oven.
Figure 5:
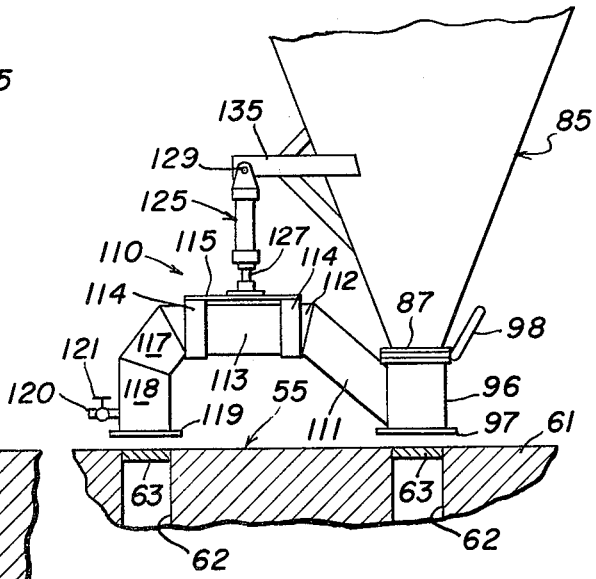
FIG. 5 is an elevational view of a portion of the system illustrated in FIG. 3 showing the U-tube in the retracted position thereof.

A motor 125 having a cylinder 126 and a piston 127 is connected by a mounting fixture 128 to the mounting plate 115 on the U-tube 110. The end of the motor 125 away from the mounting fixture 128 is pivotally connected at 129 to a support structure 135 extending from the associated coal hopper 85. Spaced apart joists 136 and 137 re-enforce the support structure 135 to hold the motor 125 in position, which in turn supports the U-tube 110. As seen in FIGS. 3 and 5 of the drawings, the U-tube 110 is movable between a position wherein the flange 119 on the leg 118 is in sealing relation with the top 61 of the coke oven and the leg 118 is in registry with a port 62 of a coking oven 60*b*. In this position the sleeve 96 is in its fully extended position wherein the flange 97 thereof is in sealing relation with the top 61 of the coke oven and the sleeve is in registry with the port 62 of the charging oven 60*a*. The piston 127 of the motor 125 is extended sufficiently to insure continuous pressure on the mounting plate 115, continually to urge the flanges 119 and 97 to their sealing positions. The sliding valve 88 may be moved to the open position thereof to accommodate the discharge of coal from the hopper 85 through the discharge tube 95 into the charging oven 60*a*.

The motor 125 is operable to move the U-tube to the second position thereof, shown in FIG. 5, wherein the U-tube is spaced away from the top 61 of the bank of coke ovens 55 to facilitate movement of the larry car 80. The piston 127 is withdrawn thereby lifting the U-tube 110 and the sleeve 96 permitting the covers 63 to be positioned in the respective ports 62 and to facilitate movement of the larry car 80 along the rails 76.

Figure 6:
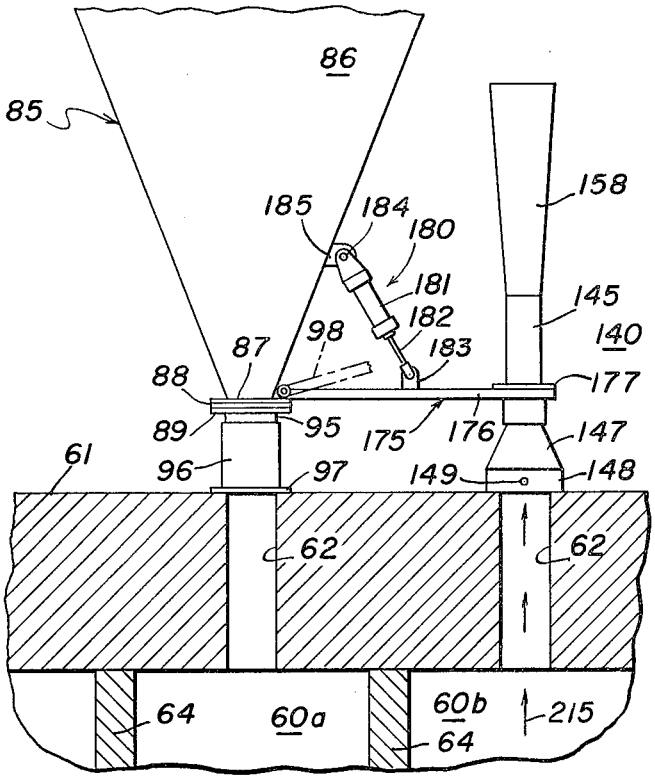
FIG. 6 is an elevational view of the venturi tube in communication with the coking oven.
Figure 7:
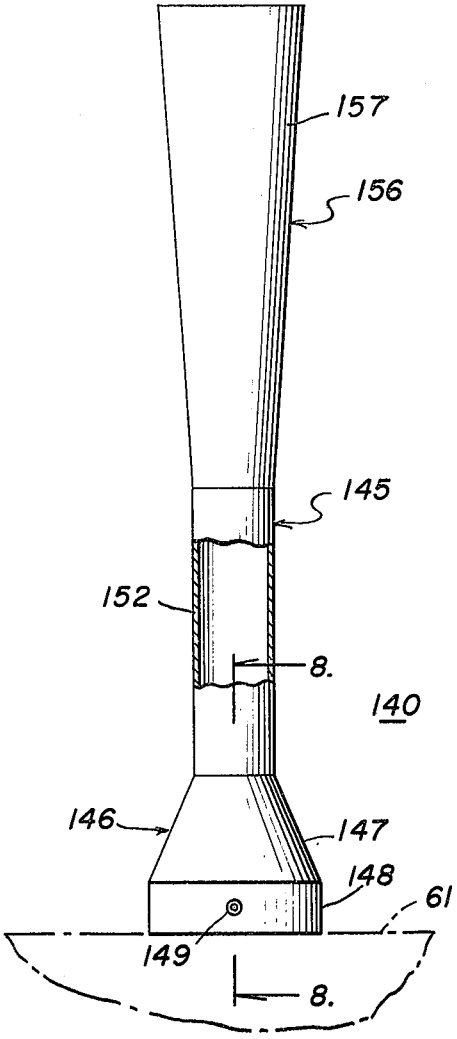
FIG. 7 is an enlarged elevational view of the venturi tube illustrated in FIG. 6.
Figure 8:
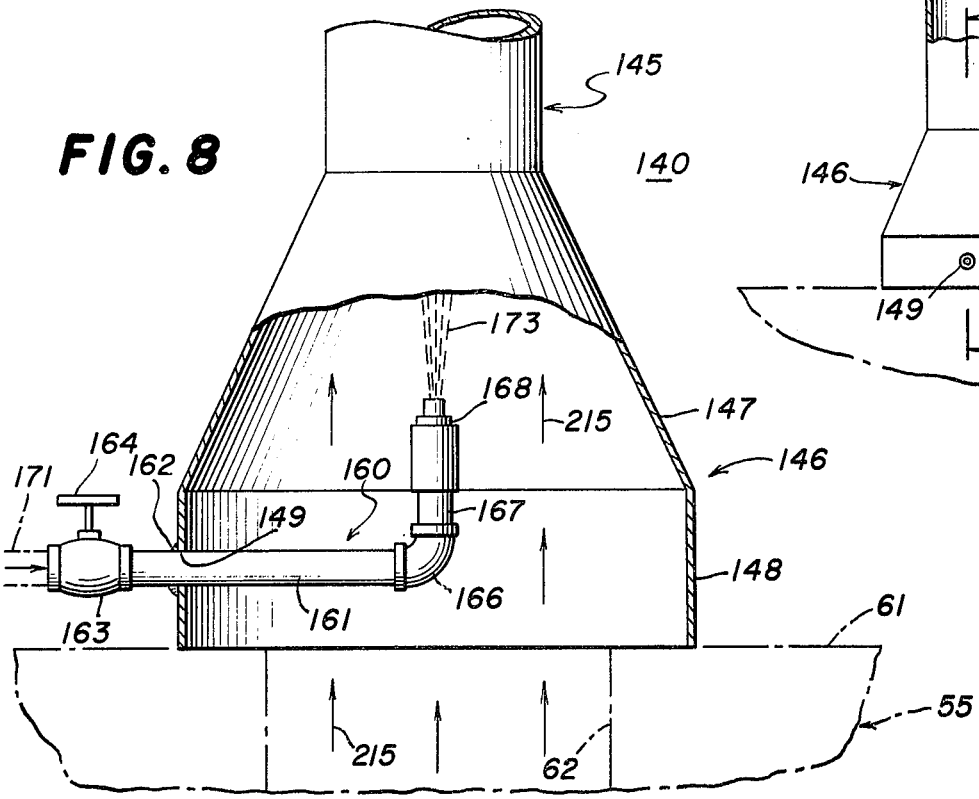
FIG. 8 is a sectional view of a portion of the venturi tube illustrated in FIG. 7 taken along lines 8—8 thereof, particularly illustrating the steam jet.

Referring now to FIGS. 6 to 8, there is disclosed a pressure reduction mechanism 140 which includes a venturi tube 145 having a lower bell or flared portion 146, the wall thereof 147 being conical in shape. A cylindrical hood 148 extends downwardly from the cone 147 and has an aperture 149 therein. Extending upwardly from the lower bell 146 is a restricted portion or neck 152, the neck being elongated and of uniform diameter. An outwardly flaring bell or flare 156 extends upwardly of the neck 152 and is formed of a conical wall 157. The venturi tube 145 is provided with a steam jet 160 which includes a horizontal pipe 61 extending outwardly the venturi tube through the aperture 149. The pipe 161 is welded to the cylindrical hood 148 as at 162 thereby to provide an air tight seal between the pipe 161 and the hood 148. A valve 163 is mounted on the distal end of the pipe 161 and has a control 164 for monitoring the flow of steam therethrough. The other end of the pipe 161 is provided with an elbow 166 leading to a short pipe section 167 connected to a nozzle 168. The nozzle 168 is positioned centrally of the venturi tube 145 along the central axis thereof to direct steam vertically upwardly through the venturi tube.

As seen in FIG. 2, a steam line 170 is connected to a source of steam (not shown) and has hook-ups 171 extending perpendicularly therefrom adjacent to each coke oven 60. Specifically, each hook-up 171 is positioned adjacent to the nearest loading port 162 of the corresponding coke oven 60 and is provided with a control 172 for shutting off steam when the associated coke oven is not being used by the system 50 of the present invention. Steam flowing through the line 170 and the appropriate hook-up 171 through the valve 163 and the nozzle 168 forms a steam jet stream 173, see FIG. 8, directed vertically upwardly through the venturi tube 145.

As seen in FIG. 6, support structure 175 in the form of three arms 176 is pivotally mounted on the associated hopper 85 and is connected to the venturi tube 145 by a ring 177. A motor 180 having a pneumatic cylinder 181 with a piston 182 extending therefrom is connected to the support structure 175 by a pivot 183. The other end of the motor 180 is pivotally connected to the hopper 85 as at pivot 184 and mounting tab 185. As shown in FIG. 6 of the drawings, the motor 180 is operated to move the venturi tube 145 into sealing relation with the associated coke oven 60*b* by positioning the venturi tube so it is in registry with the associated port 62. In this position, the piston 182 is extended to provide continuous pressure on the venturi tube 145 to insure a seal between the periphery of the cylindrical hood 148 and the top 61 of the coke oven 60*b*. When the motor 180 is actuated to withdraw the piston 182, the venturi tube 145 is moved away from the top 61 of the coke oven 60 thereby to facilitate movement of the larry car 80. When the venturi tube 145 is moved away from the top 61 of the coke oven 60*b*, the cover 63 may be inserted into the port 62 to seal the same.

In a constructional example of the present invention, the venturi tube 145 is 8 feet long with the elongated neck 152 thereof being 30 inches long. The upper conical portion 156 is 50 inches long and the lower conical portion 146 is 10¾ inches long with the cylindrical hood being 5¼ inches long. The internal diameter of the cylindrical hood 148 is 17.5 inches while the internal diameter of the neck is 8.125 inches. The upper conical portion 156 extends from an internal diameter of 8.125 inches at the juncture with the neck 152 to an internal diameter of 15 inches at the distal end of the cone. The steam pipe 160 has a vertical extent of 6 inches from the center line of the pipe to the distal end of the nozzle 168 and the distal end of the nozzle 168 is positioned 8 inches below the juncture between the lower bell 146 and the neck 152.

In use, the larry car 80 travels to the source of coal and there receives a load in each of the hoppers 85 through the appropriate loading port 105. Preferably, the total capacity of the four hoppers 85 is sufficient completely to fill one coke oven 60*a*. After the coal hoppers 85 have each been filled to capacity, the larry car 80 travels along the rails 76 by means of mechanism (not shown) until the hoppers 85 are in registry with the coke oven 60*a* to be charged.

Figure 4:
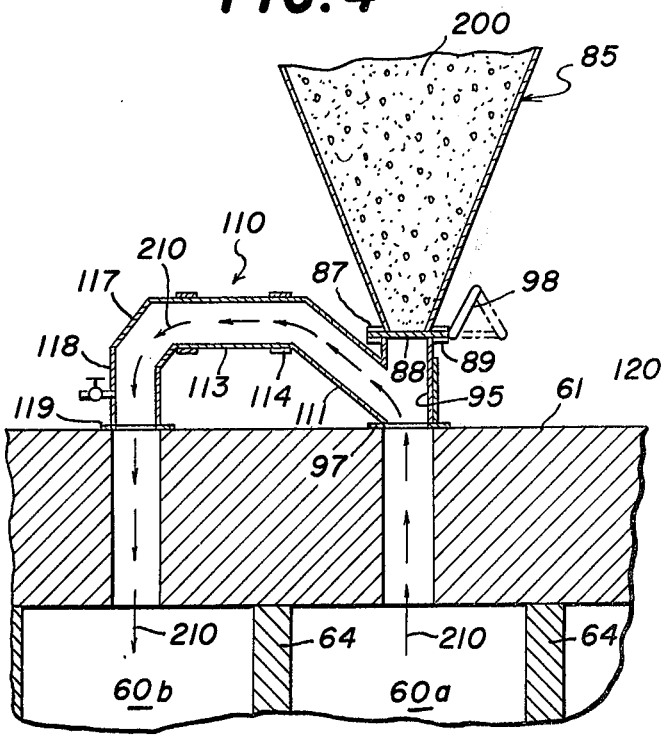
FIG. 4 is a sectional view of a portion of the larry car and U-tube illustrated in FIG. 3, particularly showing the U-tube providing communication between the coking oven and the charging oven.

At this time the sleeves 96 of each discharge tube 95 are in the raised or retracted position. Similarly, the U-tube 110 and the venturi tube 145 are spaced away from the top 61 of the coke ovens 60*a* and 60*b*, respectively. The larry car 80 is positioned so that the discharge tubes 95 of each of the coal hoppers 85 are in registry with respective ones of the charging ports 62 for the oven 60a, and the venturi tube 145 is in position to be moved into registry with the appropriate charging port 62 of a coking oven 60b. After the associated covers 63 are removed from the charging ports 62, the sleeves 96, the U-tube 110 and the venturi tube 145 are moved to the positions shown in FIGS. 3 and 6. At this point communication is established between the charging oven 60*a* and the coking oven 60*b* via the U-tube 110. Activation of the steam jet 160 is accomplished connecting the valve 163 to the hook-up 171 and results in an area of reduced pressure in the venturi tube 145 and in the coke oven 60*b*. A draft is established across the coking oven 60*b* which sucks air and gases present in the charging oven 60*a* upwardly as shown in FIG. 4 by the arrows 210 from the charging oven 60*a* through the U-tube 110 and into the coking oven 60*b*. At this time the air valve 120 is opened to permit air to enter the U-tube and to be drawn into the coking oven 60*b* along with gases present in the charging oven 60*a*.

Activation of the sliding valves 88 results in gravity flow of coal 200 stored in the hoppers 85 downwardly from the hoppers 85 through the associated discharge tubes 95 into the charging oven 60*a*. Immediately, effluents containing large quantities of coal dust are produced; however, the draft created by the steam jet 160 in combination with the venturi tube 145 sucks the effluents from the charging oven 60*a* and conveys same through the U-tube 110 into the coking oven 60*b*. The coking oven 60*b* with the charge of coal 205 therein under coking conditions is at an elevated temperature. As the coal dust present in the effluents passes over the charge 205, the coal dust is incinerated by reaction with the oxygen present from the air valve 120.

It is unclear whether all the coal dust is incinerated in the coking oven 60*b* or whether some incineration of the coal dust takes place in the venturi tube 145. In any event, the coal dust is substantially and entirely incinerated such that the exhaust on top of the venturi tube 145 is colorless and free of coal dust. The restricted neck 152 of the venturi tube imparts sufficient speed to the gases so that substantially all of effluents produced in charging the oven 60*a* is accommodated by the present system 50. The combination of the restricted neck 152 of the venturi tube 145 and the action of the steam jet 160 is sufficient to prevent a significant increase of the pressure in the oven 60*a* due to the charging thereof with the coal 200. It is important to prevent undue pressure from building up in the charging oven 60*a* if the objects of the present invention are to be obtained. If the pressure in the charging oven 60*a* becomes unduly high, then the coal dust present therein will vent through cracks in the oven 60*a* and be discharged to the atmosphere. Accordingly, the venturi tube 145 must be designed in cooperation with the steam jet 160 to provide sufficient draft across the coking oven 60*b* and sufficient disposal capacity to accommodate substantially all the effluents produced during the charging operation in a time span short enough to prevent the undesirable pressure build-up in the charging oven 60*a*.

Once the charging operation has been completed, the steam jet 160 is turned off and the valve 163 is disconnected from the associated hook-up 171. The motors 125 and 180 are activated to raise the U-tube 110 and the venturi tube 145 away from the top 61 of the coke oven 60. Similarly, each of the sleeves 96 of the discharge tubes 95 are raised to permit the covers 63 to be inserted in each of the ports 62. The larry car 80 is now in position to travel to the source of coal to obtain a new load to repeat the procedure just described. While it is well known in the art that it is undersirable to draw across a coking oven 60*b*, the present operation can be accomplished in a few minutes thereby preventing excessive and damaging temperatures in the coking oven.

While the present system 50 is shown with the venturi tube 145 venting to the atmosphere anti-pollution laws may well require that the gases from the venturi tube be further treated. If this be the case, it is well within the skill of the art to connect the top 157 of the venturi tube 145 to a collector main (not shown) for conveying the gases to a treatment station.

While there has been described what is at present considered to be the preferred embodiment of the present invention, it will be understood that various modifications and alternations may be made herein without departing from the true spirit and scope of the present invention, and it is intended to cover in the appended claims all such modifications and alterations as fall within the true spirit and scope of the present invention.

What is claimed is:

1. A system for preventing effluents containing coal dust from being emitted from coke ovens upon charging certain of the coke ovens with coal while coking in others of the coke ovens, comprising means for providing communication between one end of a first oven being charged with coal and one end of a second oven having coal coking therein, means for introducing air into the second oven with the effluents flowing from the first oven through said communication means, a venturi tube in communication with the other end of the second oven, said venturi tube having a restriction therein to accelerate effluents therethrough at a rate sufficient to accommodate substantially all of the effluents produced during the charging of the first coke oven, and means connected to said venturi tube for reducing the pressure in the venturi tube and in the second oven adjacent thereto to increase the draft through the second oven thereby facilitating flow of effluents from the first oven through the entire second oven to said venturi tube, whereby effluents containing coal dust produced during the charging of coal to the first oven are drawn through the entire second oven with sufficient oxygen to incinerate the coal dust and are accelerated through said venturi tube sufficiently to prevent effluents containing coal dust from leaking to the atmosphere due to pressure build-up in the first oven.

2. The system set forth in claim 1, wherein said communication means is a U-tube in sealing relation with a charging port in the first oven and with a charging port in the second oven.

3. The system set forth in claim 1, wherein said communication means is a U-tube having an air valve connected thereto for admitting air into said U-tube to mix with the effluents flowing from the first oven to the second oven.

4. The system set forth in claim 1, wherein said venturi tube has a flared end in sealing relation with the top of the second oven to prevent leaking of effluents between the top of the second oven and the venturi tube.

5. The system set forth in claim 1, wherein the diameter of the restriction of said venturi tube is less than one-half of the diameter of the flared end of said venturi tube adjacent to said second oven.

6. The system set forth in claim 1, wherein said pressure reducing means is a steam jet positioned to eject steam upwardly through said venturi tube.

7. The system set forth in claim 1, wherein said pressure reducing means is a steam jet fixedly mounted on said venturi tube and extending therebeyond, said steam jet having a nozzle on one end thereof for ejecting steam therefrom vertically upwardly through said venturi tube and having the other end thereof extending beyond said venturi tube for connection to a source of steam.

8. A system for preventing effluents containing coal dust from being emitted from coke ovens upon charging certain of the coke ovens with coal while coking in others of the coke oven, comprising a larry car having a plurality of coal hoppers thereon for transferring coal from a source thereof to a first coke oven to be charged with coal, a U-tube mounted on said larry car and being movable between a first position wherein said U-tube provides communication between one end of an oven being charged with coal and one end of a second oven having coal coking therein and a second position wherein said U-tube is spaced away from the top of the coke ovens to facilitate movement of the larry car, means for introducing air into the second oven with the effluents flowing from the first oven through said U-tube, a venturi tube mounted on said larry car and being movable between a first position wherein said venturi tube is in communication with the other end of the second oven and a second position wherein said venturi tube is spaced away from the top of the second oven to facilitate movement of the larry car, said venturi tube having a restriction therein to accelerate effluents therethrough at a rate sufficient to accommodate substantially all of the effluents produced during the charging of the first coke oven, and means connected to said venturi tube when said venturi tube is in the first position for reducing the pressure in the venturi tube and in the second oven adjacent thereto to increase the draft across the second oven thereby facilitating flow of effluents from the first oven through the entire second oven to said venturi tube, whereby effluents containing coal dust produced during the charging of coal are drawn through the entire second oven with sufficient oxygen to incinerate the coal dust and are accelerated through said venturi tube sufficiently to prevent effluents containing coal dust from leaking to the atmosphere due to pressure build-up in the first oven.

9. The system set forth in claim 8, and further comprising motor mechanism mounted on one of said coal hoppers for moving said U-tube between the first position thereof and the second position.

10. The system set forth in claim 8, wherein said means for introducing air into the coking oven is a valve mounted on said U-tube.

* * * * *